United States Patent [19]

Zeigler

[11] 4,351,157

[45] Sep. 28, 1982

[54] METHOD AND APPARATUS FOR FORMING ICE SCULPTURES OR THE LIKE

[76] Inventor: Andy W. Zeigler, Pine Acres, Milford, Pa. 18337

[21] Appl. No.: 238,053

[22] Filed: Feb. 25, 1981

Related U.S. Application Data

[63] Continuation of Ser. No. 29,232, Apr. 11, 1979, abandoned.

[51] Int. Cl.[3] ..... F25C 1/00

[52] U.S. Cl. ..... 62/1; 62/66; 62/340

[58] Field of Search ..... 62/261, 66, 259 R, 354, 62/74, 347, 340, 1

[56] References Cited

U.S. PATENT DOCUMENTS

| | | | |
|---|---|---|---|
| 2,134,787 | 11/1938 | Hartman | 62/264 X |
| 2,251,705 | 8/1941 | Gonzalez | 62/259 R X |
| 2,773,356 | 12/1956 | Coblentz | 62/6 |
| 2,959,940 | 11/1960 | McDonald | 62/458 |
| 2,959,942 | 11/1960 | McDonald | 62/526 |
| 3,328,974 | 7/1967 | Matsushita | 62/246 |
| 3,534,563 | 10/1970 | Ross | 62/354 X |
| 3,952,538 | 4/1976 | Warlick | 62/342 |
| 3,958,428 | 5/1976 | Kelso | 62/233 X |
| 3,958,968 | 5/1976 | Hosaka | 62/354 X |
| 4,107,943 | 8/1978 | Ohling | 62/347 X |

*Primary Examiner*—William E. Tapolcai
*Attorney, Agent, or Firm*—Steele, Gould & Fried

[57] ABSTRACT

An apparatus for forming ice scupltures or the like, comprising a housing, a sleeve member of predetermined shape, having an outer, ice-forming surface fully exposed to the ambient atmosphere, disposed on said housing; and, means for refrigerating the sleeve member, having a portion thereof disposed in the housing, evaporator means disposed in the sleeve member and a circulating refrigerating fluid which flows upwardly through the evaporator means, whereby a substantial layer of ice, formed only from moisture available in the ambient atmosphere is formed on the outer surface of the sleeve member in the predetermined shape. In place of a sleeve member, a helix of stacked coils may provide an ice-forming surface. The apparatus may be further provided with timing means for automatically controlling the refrigerating means, means for controlling the temperature and light means disposed atop the sleeve member. The sleeve member may also be coated with a color, providing a background hue for the layer of ice.

16 Claims, 2 Drawing Figures

METHOD AND APPARATUS FOR FORMING ICE SCULPTURES OR THE LIKE

CROSS REFERENCE TO RELATED APPLICATION

This is a continuation of application Ser. No. 29,232, filed Apr. 11, 1979, now abandoned.

BACKGROUND OF THE INVENTION

1. Field of the Invention

This invention relates generally to the field of ice sculptures, and in particular, to an apparatus for forming ice sculptures of predetermined shape in environments not otherwise conducive to the formation of ice.

2. Description of Prior Art

One device known in the art comprises apparatus simulating the appearance of a natural object, statuary, or like objects, the interior of which includes means for circulating a chilling medium therethrough. The apparatus proports to chill the exterior surface to any desired extent, however, in fact, the apparatus is capable of creating only a very thin layer of frost or ice crystals. It is entirely incapable of forming a substantial layer of ice.

Also known in the art are imitation ice ornaments. One such ornament utilizes a transparent hollow body made of synthetic resin in place of real ice. Refrigerating means chill the surface of the hollow body only insofar as necessary to cause water vapor to condense on the outer surface, creating the illusion of melting ice. Such an apparatus is also incapable of forming a substantial layer of ice.

Other apparatus are known for frosting glasses prior to use, however, these apparatus too are incapable of forming substantial layers of ice on surfaces fully exposed to the ambient atmosphere.

This invention accomplishes that which has not been possible in the prior art, namely, an ice sculpture formed with a substantial layer of ice. In the presently preferred embodiment, an apparatus for forming ice sculptures or the like, comprises a housing, a sleeve member of predetermined shape disposed on the housing and means for refrigerating the sleeve member disposed in the housing and the sleeve member, whereby a layer of ice is formed on the sleeve member. The refrigerating means comprises a condensor and compressor disposed in the housing and an evaporator disposed in the sleeve member. The sleeve member is in substantial surface contact with the evaporator, in the presently preferred embodiment, a stacked helix of pipe coils. The sleeve member is formed of a highly thermally conductive material, and a layer of ice forms on the outside surface of the sleeve member. As a further decorative embelishment, the apparatus may further comprise light means disposed atop the sleeve member, and the sleeve member may be coated with a color, providing a background hue for the layer of ice.

SUMMARY OF THE INVENTION

It is an object of this invention to provide an apparatus for forming ice sculptures or the like.

It is another object of this invention to provide an apparatus for forming ice sculptures or the like, in an environment not otherwise conducive to the formation of ice.

It is still another object of this invention to provide an apparatus for forming ice sculptures or the like, in a substantially portable structure.

It is yet another object of this invention to provide an apparatus for forming ice sculptures or the like of predetermined shape.

It is yet another object of this invention to provide an apparatus for forming ice sculptures or the like in a variety of predetermined shapes.

It is yet another object of this invention to provide an apparatus for forming ice sculptures or the like, which further provides automatic controlling means and light means in combination with the ice sculpture.

These and other objects of this invention are accomplished by an apparatus for forming ice sculptures or the like, comprising a housing, a sleeve of predetermined shape disposed on the housing and means for refrigerating the sleeve member disposed in the housing and the sleeve member, whereby a layer of ice is formed on the sleeve member. For certain configurations it may be desirable to omit the sleeve member. The refrigerating means comprises a condensor and compressor disposed in the housing and an evaporator disposed in the sleeve member; the compressor, the condensor and the evaporator being in fluid communication. Fluid flow from the compressor to the evaporator is directed through an expansion valve. The sleeve member is in substantial surface contact with surface contact with the evaporator, and preferably, the sleeve member is formed of a highly thermally conductive material. In the presently preferred embodiment, the evaporator comprises a stacked helix of pipe coils, supported by a centrally disposed, insulating support member, having a hollow core. The hollow core provides a conduit for the return pipe of the evaporator. The apparatus may also be provided with light means disposed atop sleeve member, the hollow core of the central support member also serving as a conduit for electrical circuit connection means for the light means. The apparatus may be further provided with timing means for automatically controlling the refrigerating means and means for controlling temperature. As a still further decorative embelishment, the sleeve member may be coated with a color, providing a background hue for the layer of ice.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF PREFERRED EMBODIMENT

Figure 1:
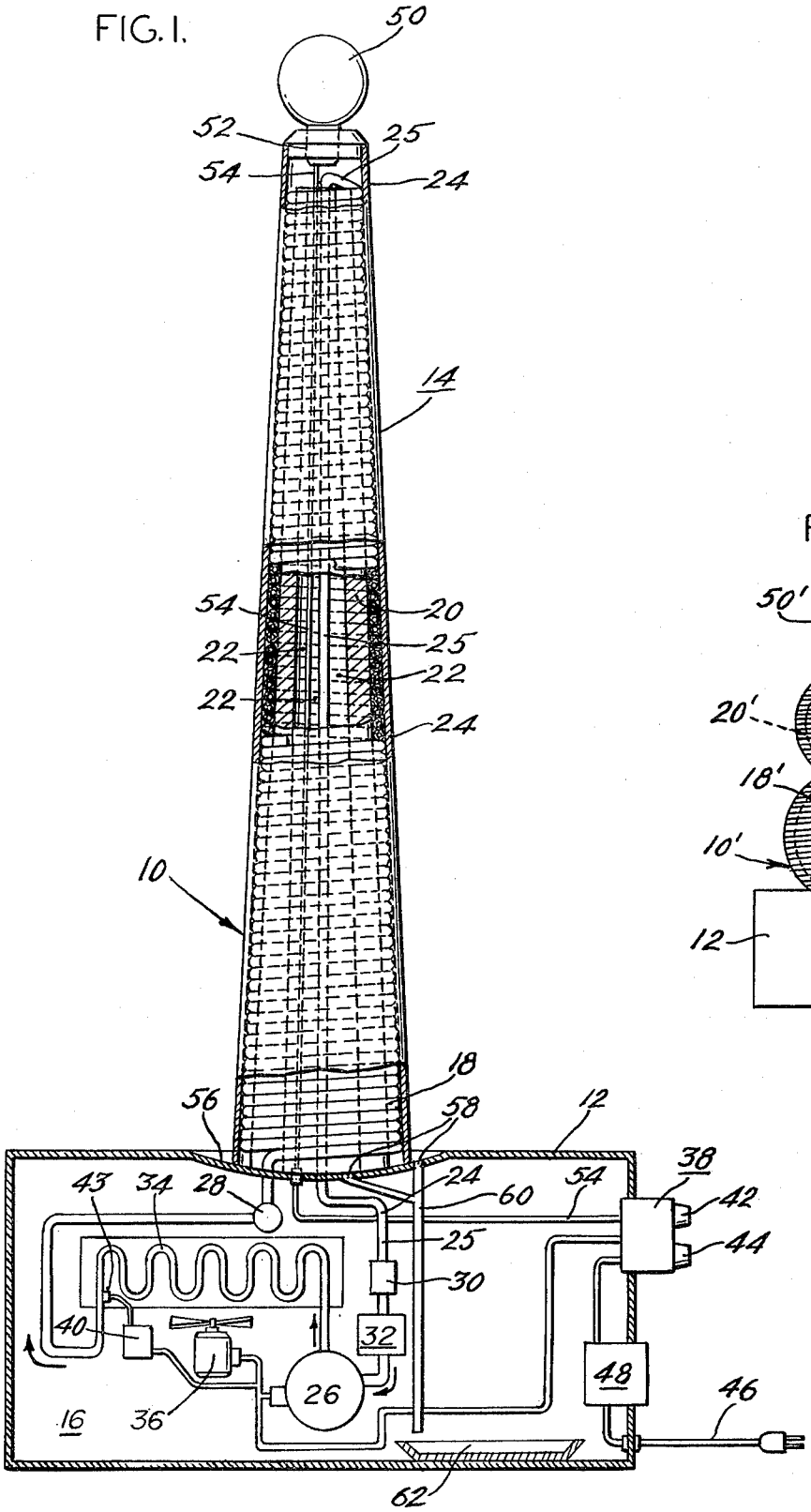
FIG. 1 is a side view in partial section of an apparatus for forming ice sculptures or the like according to this invention, the ice sculptures being in the form of an ice pole; and, FIG. 2 is a diagramatic representation of an alternate embodiment of the apparatus shown in FIG. 1, wherein the ice sculpture is in the form of a snowman.

An apparatus 10 for forming ice sculptures or the like according to this invention is illustrated in FIG. 1. The apparatus 10 comprises a lower housing 12 and upper projecting member 14, on which a layer of ice may be formed. The apparatus is provided with means 16 for refrigerating member 14. The refrigerating means 16 is illustrated diagramatically, with a portion thereof being disposed in the housing 12 and a portion thereof being disposed in member 14.

Member 14 comprises a helix of stacked pipe coils 18, surrounding and supported by a central support member 20, having a hollow core 22, and covered by a sleeve member 24.

The pipe helix 18 is the evaporator for the refrigerating means 16, and is preferably metal, such as copper. The hollow central support member 20 is preferably an insulating material, such as a foam or plastic material. The sleeve member 24 is preferably a material which is highly thermally conductive, such as aluminum. It is important that sleeve member 24 be in substantial surface contact with the outer surface of the pipe helix 18.

Core 22 of support member 20 provides a conduit for the return pipe 25 of the pipe helix 18.

The remaining elements of refrigerating means 16 are conventional components, and are disposed in housing 12. These components include compressor 26, expansion valve 28, a filtering and drying element 30, a liquid receiving means 32, a condensor 34, and a fan 36 for the condensor 34. The refrigerating means 16 utilizes conventional refrigerating fluids, such as freon. The direction of fluid flow of the refrigerant is indicated by the arrows. As indicated, the refrigerant is compressed and pumped by compressor 26 through condensor 34, where it is cooled by fan 36, through expansion valve 28, up the pipe coil helix 18, down return pipe 25, through filtering and drying means 30 into the liquid receiving means 32, and back through compressor 26.

As a result of forming the evaporator of the refrigerating means in a stack of coils, and surrounding the stack of coils by a highly thermally conductive material in substantial surface contact with the stack of coils, it is possible to form a substantial layer of ice on the outer surface of the thermally conductive sleeve, even in environments not otherwise conducive to the formation of layers of ice, such as inside heated buildings or the like. The ice forming surface is fully exposed to the ambient atmosphere, the layer of ice being formed only from moisture condensed from the ambient atmosphere.

One of the many applications for the apparatus illustrated in FIG. 1 is as an ice pole or a "North Pole" to be used by stores and shopping malls in conjunction with Christmas displays and appearances by Santa Claus. To this end, the apparatus may be provided with control means 38 and temperature range control means 40. The control means 38 may be provided with a 24 hour clock timing mechanism, operated by dial 42. The temperature range control means 40 is provided with a temperature sensor 43, adjacent the output of the condensor 34, and is controlled by dial 44, conveniently located adjacent the control dial of the 24-hour clock. The apparatus is energized through power cord 46, and protected against overload and danger from electrical shock by circuit breaking means 48.

In furtherence of the decorative application of the apparatus, it may also be provided with light means 50. Light means 50 may, for example, be a large frosted light bulb, or an ordinary light bulb mounted in a frosted globe. Light means 50 is mounted by means of plug 52, in the top of member 14, and is connected to control means 38 by circuit connection means 54, also passing through core 22 of central support member 20.

During the course of operation of the ice forming apparatus, frost will first appear on the outer surface of sleeve 24. After some time, successive layers of frost will form a substantial layer of ice. It is possible that some water will not be frozen, but will drip down sleeve member 24. This will certainly be the case when the apparatus is shut off. Accordingly, upper member 14 is mounted in a basin or depression 56, formed in the top of housing 12. Basin 56 is provided with one or more drain holes 58, which channel the liquid water through tube 60 into removably mounted tray 62. The provision of an additional drain hole within the periphery of upper member 14 provides an outlet for any water which may condense and drip inside support member 20.

Figure 2:
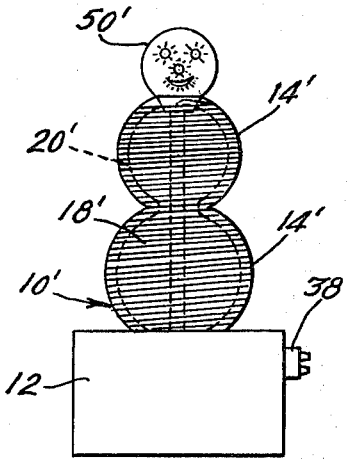

Use of the apparatus taught in this invention makes it possible to form an ice sculpture or the like in virtually any shape which can be defined by the combined structure of a stacked coil helix and a corresponding thermally conductive sleeve member in substantial surface contact with the pipe helix. In some cases, it may be difficult or uneconomical to form the sleeve member in a particular shape. Therefore, some apparatus may be constructed without an outer sleeve member. Such an alternative structure is shown diagramatically in FIG. 2. FIG. 2 illustrates an ice sculpture in the form of a snowman. The apparatus 10′ comprises a lower housing 12 and an upper projecting member, comprising stacked spherical layers 14′. The diameters of the coils of the pipe helix 18′ vary in size in accordance with the desired or predetermined shape of the ice sculpture. The light means 50′ may be adapted in the form of a face, with light shining through the eyes, nose and mouth of the snowman. The light means 50′ may rest upon the top of the central support member 20′, which may also be of the overall corresponding shape. In order to support the pipe coils in the lower half of each spherical layer, it may be desirable to form corresponding grooves around the outside surface of the central support member, in which the coils of pipe may be disposed.

Generally speaking, the stacked pipe helix will be self-supporting in the vertical direction but may require support against lateral displacement of particular coils in the helix. As an alternative, it is also possible to form the outer sleeve 24 with grooves corresponding to the pipe helix, thereby providing support and guidance for the coils of the helix, without need for a central support member.

The present invention may be embodied in other specific forms without departing from the spirit or essential attributes thereof, and accordingly, reference should be made to the appended claims, rather than to the foregoing specification as indicating the scope of the invention.

I claim:

1. An apparatus for forming ice sculptures and the like, comprising:

a housing;

a helical stack of pipe coils forming a continuous composite surface of predetermined shape, disposed on said housing and fully exposed to the ambient atmosphere;

means disposed in said housing for refrigerating said helical stack of coils, said stack of coils also forming evaporator means for the refrigerating means; and, a substantial layer of ice formed upon operation of the refrigerating means, from successive layers of frost on substantially all of said surface in said predetermined shape, the layer of ice formed only from moisture condensed from the ambient atmosphere.

2. An apparatus for forming ice sculptures and the like comprising:

a housing;

a helical stack of pipe coils forming a continuous composite surface of predetermined shape, disposed on said housing;

a sleeve member formed from highly thermally conductive material overfitting said helical stack of coils and in substantial surface contact therewith, said sleeve member providing an outer ice-forming surface fully exposed to the ambient atmosphere;

means disposed in said housing for refrigerating said helical stack of coils, said stack of coils also forming evaporator means for the refrigerating means;

said means for refrigerating further including a circulating refrigerating fluid which flows upwardly through the helical stack of pipe coils; and a substantial layer of ice formed upon operation of the refrigerating means, from successive layers of frost on substantially all of said sleeve member, the layer of ice formed only from moisture condensed from the ambient atmosphere.

3. The apparatus of claim 2, wherein said sleeve member is aluminum.

4. The apparatus of claim 2, wherein said refrigerating means comprises a condensor and compressor disposed in said housing; said compressor, said condensor and said evaporator being in fluid communication; and wherein said fluid flow from said condensor to said evaporator is directed through an expansion valve.

5. The apparatus of claim 4, wherein said coils of pipe have diameters which vary in accordance with said predetermined shape.

6. The apparatus of claims 2 or 1, wherein said predetermined shape is a pole.

7. The apparatus of claim 4, wherein said refrigerating means further comprises a filter dryer and liquid holding means disposed between said evaporator and said compressor.

8. The apparatus of claim 4 or 5, further comprising a central support member for said coils of pipe, said member having a hollow core.

9. The apparatus of claims 2 or 1, further comprising timing means for automatically controlling said refrigerating means; and, light means disposed atop the sleeve member.

10. The apparatus of claim 2, wherein said housing is provided with means for catching and channeling liquid which drips from said sleeve member.

11. The apparatus of claims 2 or 1, wherein said predetermined shape is at least two stacked, substantially spherical layers, thereby simulating the appearance of a snowman.

12. A method for forming ice sculptures and the like, comprising the steps of:

forming an evaporator for a refrigerating means by stacking a plurality of pipe coils into a continuous helix, the continuous helix of stacked pipe coils in turn forming a continuous composite surface of predetermined shape;

fully exposing the continuous composite surface to the ambient atmosphere; and, depositing successive layers of frost on the continuous composite surface by operating the refrigerating means, causing water vapor in the ambient atmosphere to condense on the continuous composite surface and be subsequently frozen, the successive layers of frost together forming a substantial layer of ice.

13. A method of forming ice sculptures and the like, comprising the steps of:

forming an evaporator for a refrigerating means by stacking a plurality of pipe coils into a continuous helix, the continuous helix of stacked pipe coils in turn forming a continuous composite surface of predetermined shape;

disposing a sleeve member formed from a highly thermally conductive material over the helical stack of pipe coils and in substantial surface contact therewith, the sleeve member having an outer surface;

fully exposing the outer surface of the sleeve member to the ambient atmosphere; and depositing successive layers of frost on the outer surface of the sleeve member and be subsequently frozen, the successive layers of frost together forming a substantial layer of ice.

14. The method of claims 12 or 13, wherein the step of operating the refrigerating means to cool the evaporator includes circulating a refrigerating fluid upwardly through the helical stack of pipe coils.

15. The method of claims 12 or 13, further comprising the step of disposing the helical stack of pipe coils on top of a housing and disposing the refrigerating means within the housing.

16. The method of claim 15, further comprising the step of collecting water, which condenses but does not freeze, in a depression formed in the top of the housing at the base of the helical stack of pipe coils.

* * * * *